US007439686B2

(12) United States Patent
Usui

(10) Patent No.: US 7,439,686 B2
(45) Date of Patent: Oct. 21, 2008

(54) DISCHARGE-LAMP LIGHTING APPARATUS

(75) Inventor: Hiroshi Usui, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 0 days.

(21) Appl. No.: 11/748,821

(22) Filed: May 15, 2007

(65) Prior Publication Data

US 2007/0273300 A1 Nov. 29, 2007

(30) Foreign Application Priority Data

May 25, 2006 (JP) ..... 2006-145731

(51) Int. Cl.
*H05B 41/16* (2006.01)

(52) U.S. Cl. ..... 315/277; 315/220; 315/255

(58) Field of Classification Search ..... 315/209 R, 315/210–212, 219–220, 224–226, 246–247, 315/250, 255, 274–277, 282, 291, 307, 312
See application file for complete search history.

(56) References Cited

U.S. PATENT DOCUMENTS

| | | | | |
|---|---|---|---|---|
| 6,127,788 | A * | 10/2000 | Yamamoto et al. | 315/307 |
| 7,279,849 | B2 * | 10/2007 | Lee | 315/220 |
| 2002/0057062 | A1 * | 5/2002 | Kisaichi et al. | 315/291 |
| 2002/0140372 | A1 * | 10/2002 | Langeslag et al. | 315/224 |
| 2003/0107329 | A1 * | 6/2003 | Oshawa | 315/276 |
| 2005/0225261 | A1 * | 10/2005 | Jin | 315/255 |
| 2006/0108947 | A1 * | 5/2006 | Maeda et al. | 315/277 |
| 2007/0247082 | A1 * | 10/2007 | Ashikaga et al. | 315/277 |
| 2008/0061711 | A1 * | 3/2008 | Jin | 315/277 |

FOREIGN PATENT DOCUMENTS

JP 2003-31383 1/2003

OTHER PUBLICATIONS

U.S. Appl. No. 11/748,888, filed May 15, 2007, USUI.
U.S. Appl. NO. 11/748,821, filed May 15, 2007, USUI.

* cited by examiner

*Primary Examiner*—Thuy Vinh Tran
*Assistant Examiner*—Tung X Le
(74) *Attorney, Agent, or Firm*—Oblon, Spivak, McClelland, Maier & Neustadt, P.C.

(57) ABSTRACT

A discharge-lamp lighting apparatus includes first and second cold cathode fluorescent lamps (CCFLs) and first and second transformers. The first transformer has a primary winding and a secondary winding. The primary winding receives an AC voltage generated by turning on/off a first switching element pair that is connected to a first DC power source. The second transformer has a primary winding, a first secondary winding, and a second secondary winding. The primary winding of the second transformer receives an AC voltage generated by turning on/off a second switching element pair that is connected to a second DC power source. Polarities of the first and second secondary windings of the second transformer are set so that a voltages of each of the first and second secondary windings becomes additive to a voltage of the secondary winding of the first transformer.

13 Claims, 5 Drawing Sheets

DISCHARGE-LAMP LIGHTING APPARATUS

BACKGROUND OF THE INVENTION

1. Field of the Invention

The present invention relates generally to a discharge-lamp lighting apparatus for lighting discharge lamps such as cold cathode fluorescent lamps (CCFLs), and particularly, to a technique of simultaneously driving a plurality of CCFLs.

2. Description of the Related Art

FIG. 1 is a view showing a configuration of a discharge-lamp lighting apparatus according to a related art. This apparatus includes a first DC power source E1 connected in series with a first switching element Q1 and a second switching element Q2. The first and second switching elements Q1 and Q2 are turned on and off in response to control signals from a first control circuit 10*a*. The first control circuit 10*a* conducts PWM control, phase control, frequency control, or the like to control the on/off operation of the first and second switching elements Q1 and Q2.

The second switching element Q2 is connected in parallel to a quasi-voltage-resonance capacitor C6. The element Q2 is also connected in parallel to a series circuit that includes a primary winding P1 of a first transformer T1 and a current resonance capacitor C4. The first transformer T1 has a leakage inductance Lr1 for managing resonance operation.

A secondary winding S1 of the first transformer T1 is connected, through a resistor RS1, in parallel to a series circuit that includes a cold cathode fluorescent lamp (hereinafter referred to as CCFL) 11*a* and a ballast capacitor C11 and a series circuit that includes a CCFL 11*b* and a ballast capacitor C12. The resistor RS1 is a current detection resistor to detect a current. A current detected by the resistor RS1 is fed back to the first control circuit 10*a* on the primary side. According to the signal fed back from the resistor RS1, the first control circuit 10*a* controls on/off periods of the first and second switching elements Q1 and Q2, thereby controlling an AC voltage applied to the primary winding P1 of the first transformer T1.

FIG. 2 shows a voltage-current characteristic of a typical CCFL. The CCFL has a negative resistance characteristic that a current (lamp current) increases as an applied voltage (lamp voltage) decreases. To relieve the negative resistance characteristic, the discharge-lamp lighting apparatus inserts an impedance element in series with a CCFL. The impedance element must have a sufficient value to absorb the negative resistance characteristic of the CCFL. When driving a single CCFL, the discharge-lamp lighting apparatus uses the leakage inductance Lr1 of the first transformer T1 as the impedance element.

When simultaneously driving a plurality of CCFLs, simply connecting the CCFLs in parallel with one another causes a problem that a CCFL that is first turned on triggers a voltage drop due to impedance to prevent the other CCFLs from being turned on. To avoid this problem, an impedance element is inserted in series with each CCFL. In the example shown in FIG. 1, the impedance elements are the ballast capacitors C11 and C12. With the ballast capacitors C11 and C12, a voltage applied to the secondary winding S1 of the first transformer T1 becomes free from the ON or OFF state of any CCFL, and therefore, all CCFLs are surely turned on.

Another example of the discharge-lamp lighting apparatus is a multi-lamp drive system disclosed in Japanese Unexamined Patent Application Publication No. 2003-31383. This multi-lamp drive system drives a lamp set consisting of first and second lamps. The system includes a drive circuit for converting a DC signal into an AC signal, a transformer whose primary side is electrically connected to the driver circuit and whose secondary side provides an AC power source, and a current balance circuit electrically connected to the lamp set to balance currents passing through the first and second lamps. The current balance circuit has a core, a first winding electrically connected to the first lamp, and a second winding electrically connected to the second lamp. The first and second windings are wound around the same core and have the same number of turns.

SUMMARY OF THE INVENTION

The discharge-lamp lighting apparatuses mentioned above have problems. In FIG. 1, the first transformer T1 must generate on its secondary winding S1 a high voltage that is the sum of voltages applied to the ballast capacitors C11 and C12 and voltages applied to the CCFLs 11*a* and 11*b*. Due to this, the apparatus must take large-scale safety measures to secure reliability, prevent leakage, and ensure creepage distances and spatial distances. These measures increase the cost of the apparatus.

A discharge-lamp lighting apparatus of the present invention needs no large-scale safety measures, greatly reduces the cost, realizes high reliability, and accurately stabilizes and balances currents passing through CCFLs that are simultaneously driven.

According to a first aspect of the present invention, provided is a discharge-lamp lighting apparatus having a first discharge lamp and a second discharge lamp in which the apparatus includes a first control circuit configured to control on/off operation of a first switching element pair connected in series with a first DC power source; a first transformer having a primary winding configured to receive an AC voltage generated by turning on/off the first switching element pair and a secondary winding configured to transform the AC voltage received by the primary winding into an output voltage; a second control circuit configured to control on/off operation of a second switching element pair connected in series with a second DC power source; and a second transformer having a primary winding configured to receive an AC voltage generated by turning on/off the second switching element pair and first and second secondary windings configured to transform the AC voltage received by the primary winding of the second transformer into output voltages. The first discharge lamp is connected in parallel to a series circuit that includes the secondary winding of the first transformer and the first secondary winding of the second transformer. The second discharge lamp is connected in parallel to a series circuit that includes the secondary winding of the first transformer and the second secondary winding of the second transformer.

According to a second aspect of the present invention, provided is a discharge-lamp lighting apparatus having a first discharge lamp and a second discharge lamp in which the apparatus includes a first control circuit configured to control on/off operation of a first switching element pair connected in series with a first DC power source; a first transformer having a primary winding configured to receive an AC voltage generated by turning on/off the first switching element pair and a secondary winding configured to transform the AC voltage received by the primary winding into an output voltage; a second control circuit configured to control on/off operation of a second switching element pair connected in series with a second DC power source; a second transformer having a primary winding configured to receive an AC voltage generated by turning on/off the second switching element pair and a secondary winding configured to transform the AC voltage received by the primary winding of the second transformer into an output voltage, the secondary winding of the second transformer being connected to the secondary winding of the first transformer with polarities being set so that the voltage of the secondary winding of the second transformer becomes additive to the voltage of the secondary winding of the first transformer; and a third transformer having a primary winding configured to receive an AC voltage generated by turning on/off the second switching element pair and a secondary winding configured to transform the AC voltage received by the primary winding of the third transformer into an output voltage, the secondary winding of the third transformer being connected to the secondary winding of the first transformer with polarities being set so that the voltage of the secondary winding of the third transformer becomes additive to the voltage of the secondary winding of the first transformer. The first discharge lamp is connected in parallel to a series circuit that includes the secondary winding of the first transformer and the secondary winding of the second transformer. The second discharge lamp is connected in parallel to a series circuit that includes the secondary winding of the first transformer and the secondary winding of the third transformer. The primary winding of the second transformer and the primary winding of the third transformer are connected to each other in one of series and parallel.

According to a third aspect of the present invention, provided is a discharge-lamp lighting apparatus having a first discharge lamp and a second discharge lamp in which the apparatus includes a first control circuit configured to control on/off operation of a first switching element pair connected in series with a first DC power source; a first transformer having a primary winding configured to receive an AC voltage generated by turning on/off the first switching element pair and a secondary winding configured to transform the AC voltage received by the primary winding into an output voltage; a second control circuit configured to control on/off operation of a second switching element pair connected in series with a second DC power source; a second transformer having a primary winding configured to receive an AC voltage generated by turning on/off the second switching element pair and a secondary winding configured to transform the AC voltage received by the primary winding of the second transformer into an output voltage, the secondary winding of the second transformer being connected to the secondary winding of the first transformer with polarities being set so that the voltage of the secondary winding of the second transformer becomes additive to the voltage of the secondary winding of the first transformer; a third control circuit configured to control on/off operation of a third switching element pair connected in series with the second DC power source; and a third transformer having a primary winding configured to receive an AC voltage generated by turning on/off the third switching element pair and a secondary winding configured to transform the AC voltage received by the primary winding of the third transformer into an output voltage, the secondary winding of the third transformer being connected to the secondary winding of the first transformer with polarities being set so that the voltage of the secondary winding of the third transformer becomes additive to the voltage of the secondary winding of the first transformer. The first discharge lamp is connected in parallel to a series circuit that includes the secondary winding of the first transformer and the secondary winding of the second transformer. The second discharge lamp is connected in parallel to a series circuit that includes the secondary winding of the first transformer and the secondary winding of the third transformer.

DESCRIPTION OF PREFERRED EMBODIMENTS

Discharge-lamp lighting apparatuses according to embodiments of the present invention will be explained in detail with reference to the accompanying drawings.

First Embodiment

Figure 3:
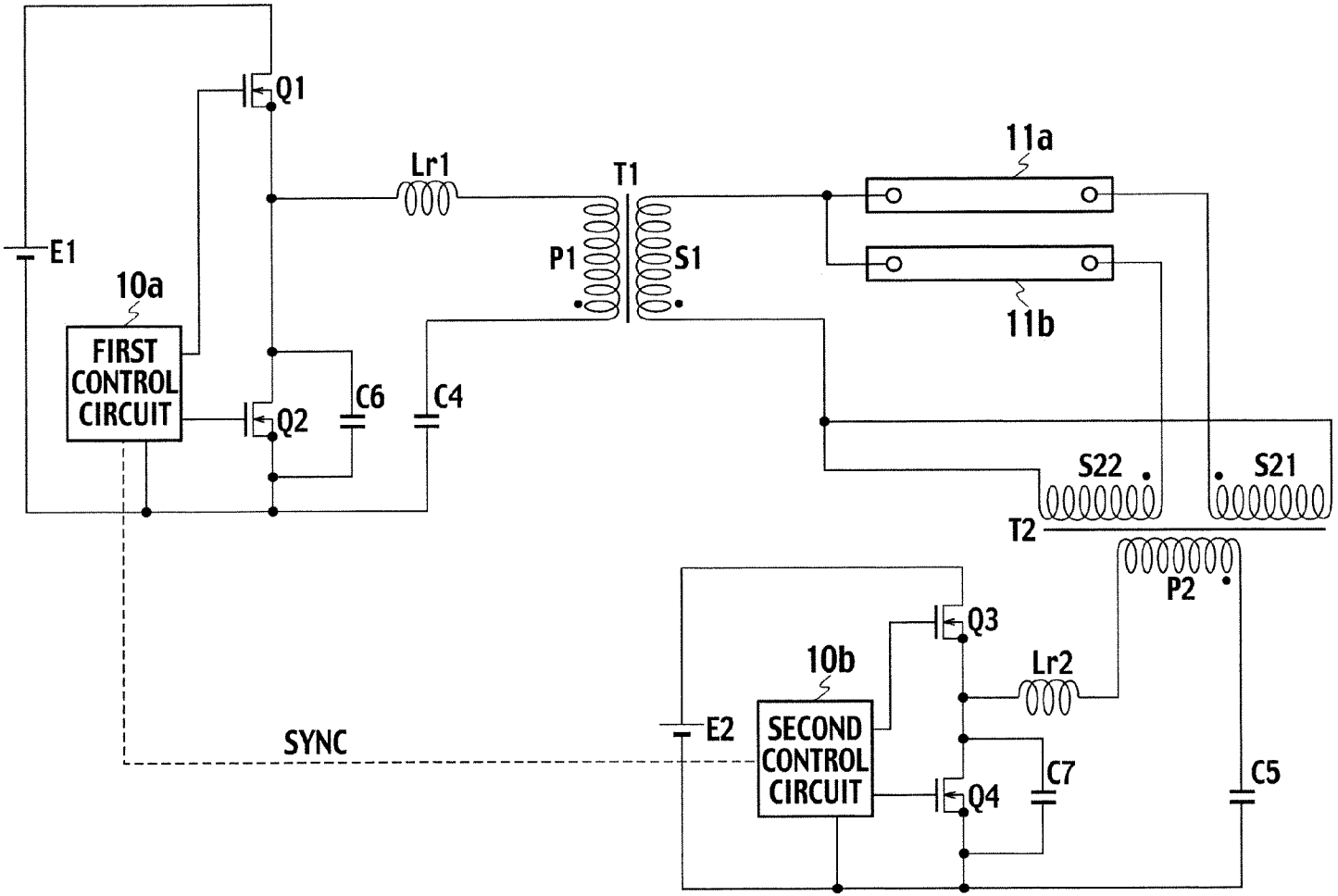
FIG. 3 is a view showing a configuration of a discharge-lamp lighting apparatus according to a first embodiment of the present invention.

FIG. 3 is a view showing a discharge-lamp lighting apparatus according to the first embodiment of the present invention. The operation and configuration of a primary side of the first embodiment are the same as those of the related art shown in FIG. 1, and therefore, explanations thereof are omitted.

Parts of the first embodiment that are different from those of the related art will mainly be explained. In FIG. 3, a first switching element Q1 and a second switching element Q2 form a first switching element pair according to the present invention. Through the drawings, a filled circle indicates a winding start point of each transformer winding. Although discharge lamps in the embodiments are CCFLs, they may be external electrode fluorescent lamps, fluorescent lamps, and the like.

Figure 1:
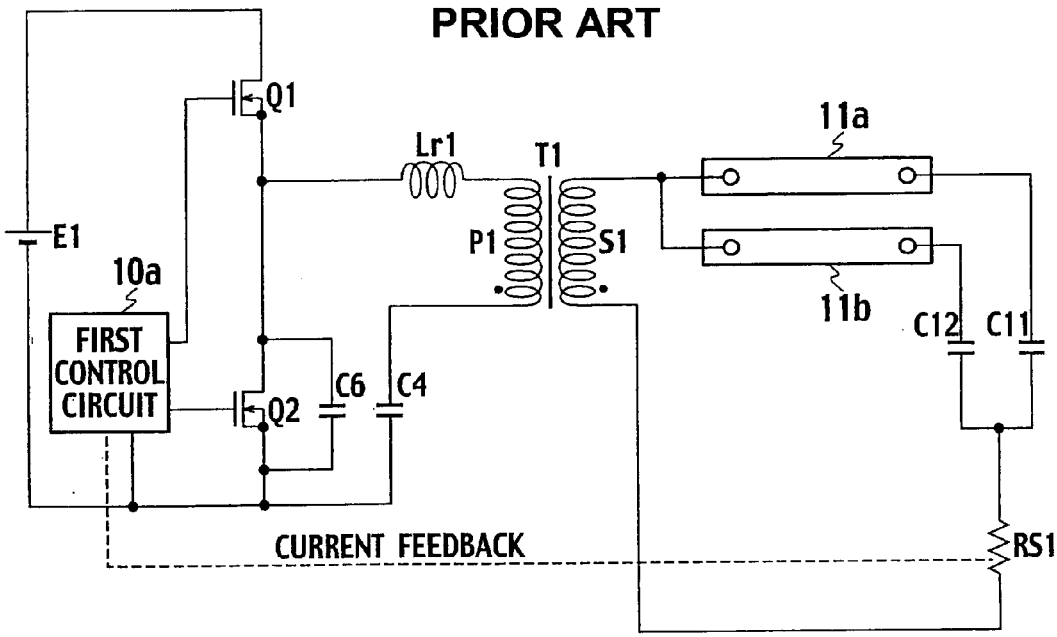
FIG. 1 PRIOR ART
FIG. 1 is a view showing a configuration of a conventional discharge-lamp lighting apparatus.
Figure 2:
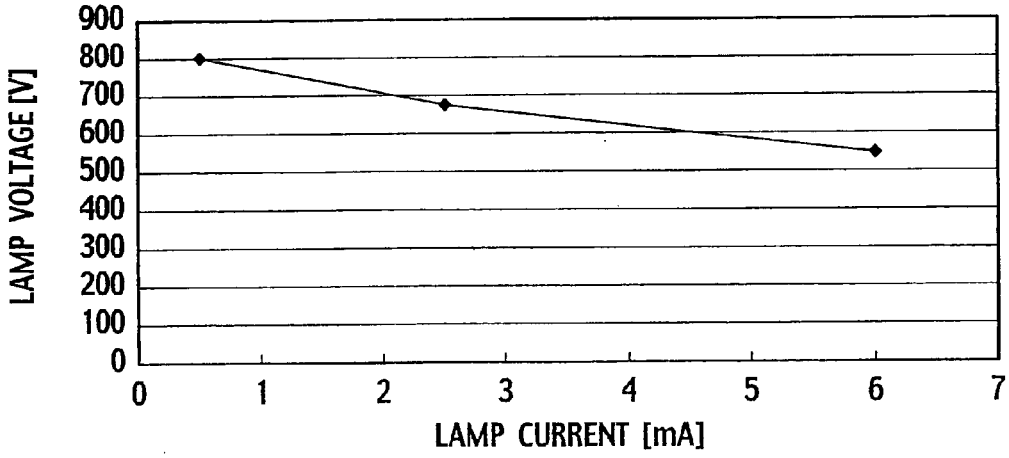
FIG. 2 PRIOR ART
FIG. 2 is a view showing a voltage-current characteristic of a typical CCFL.

The discharge-lamp lighting apparatus according to the first embodiment removes the first ballast capacitor C11, second ballast capacitor C12, and resistor RS1 with respect to the related art shown in FIG. 1 and additionally employs a second DC power source E2, a second control circuit 10*b*, a third switching element Q3, a fourth switching element Q4, a current resonance capacitor C5, a quasi-voltage-resonance capacitor C7, and a second transformer T2.

The second DC power source E2 is formed by using a power source that is on the secondary side of the apparatus and is of relatively low voltage. The third and fourth switching elements Q3 and Q4 form a second switching element pair according to the present invention.

The third and fourth switching elements Q3 and Q4 are connected in series with the second DC power source E2 and are turned on/off in response to control signals from the second control circuit 10*b*. The second control circuit 10*b* conducts PWM control, phase control, frequency control, or the like to control the on/off operation of the third and fourth switching elements Q3 and Q4. The fourth switching element Q4 is connected in parallel to the quasi-voltage-resonance capacitor C7. The element Q4 is also connected in parallel to a series circuit that includes a primary winding P2 of the second transformer T2 and the current resonance capacitor C5.

The second transformer T2 has the primary winding P2, a first secondary winding S21, and a second secondary winding S22 and contains a leakage inductance Lr2 for managing resonance operation. The three windings of the second transformer T2 are wound in order of S21, P2, and S22. The first and second secondary windings S21 and S22 of the second transformer T2 are loosely coupled to each other. A first control circuit 10*a* and the second control circuit 10*b* are controlled so that control signals provided by them are frequency-synchronized.

A secondary winding S1 of a first transformer T1 is connected in parallel to a series circuit that includes a CCFL 11*a* and the first secondary winding S21 of the second transformer T2 and a series circuit that includes a CCFL 11*b* and the second secondary winding S22 of the second transformer T2. Polarities of the first and second secondary windings S21 and S22 of the second transformer T2 are set so that voltages generated by them become additive to a voltage generated by the secondary winding S1 of the first transformer T1.

Operation of the discharge-lamp lighting apparatus according to the first embodiment having the above-mentioned configuration will be explained. An AC voltage applied to a primary winding P1 of the first transformer T1 makes the secondary winding S1 thereof generate a voltage. An AC voltage applied to the primary winding P2 of the second transformer T2 makes the first and second secondary windings S21 and S22 thereof generate voltages. As results, the CCFL 11*a* receives the sum of the voltage of the secondary winding S1 of the first transformer T1 and the voltage of the first secondary winding S21 of the second transformer T2, and the CCFL 11*b* receives the sum of the voltage of the secondary winding S1 of the first transformer T1 and the voltage of the second secondary winding S22 of the second transformer T2.

As a result, the CCFLs 11*a* and 11*b* turn on. Since the first and second secondary windings S21 and S22 of the second transformer T2 are loosely coupled to each other, ON operation of one of the CCFLs 11*a* and 11*b* little affects ON operation of the other. Namely, the CCFLs 11*a* and 11*b* can stably be turned on.

The first and second secondary windings S21 and S22 of the second transformer T2 each have a predetermined inductance to balance currents passing through the CCFLs 11*a* and 11*b*. In addition, the coupling (though loose coupling) of the first and second secondary windings S21 and S22 of the second transformer T2 prevents a large unbalance between currents thereof.

Voltages applied to the CCFLs 11*a* and 11*b* are shared between the first and second transformers T1 and T2, and therefore, an output voltage provided by any one of the first and second transformers T1 and T2 can be lower than that of the related art. This results in eliminating the need of large-scale safety measures to secure reliability, prevent leakage, and ensure creepage distances and spatial distances, thereby minimizing the cost of the apparatus.

Second Embodiment

Figure 4:
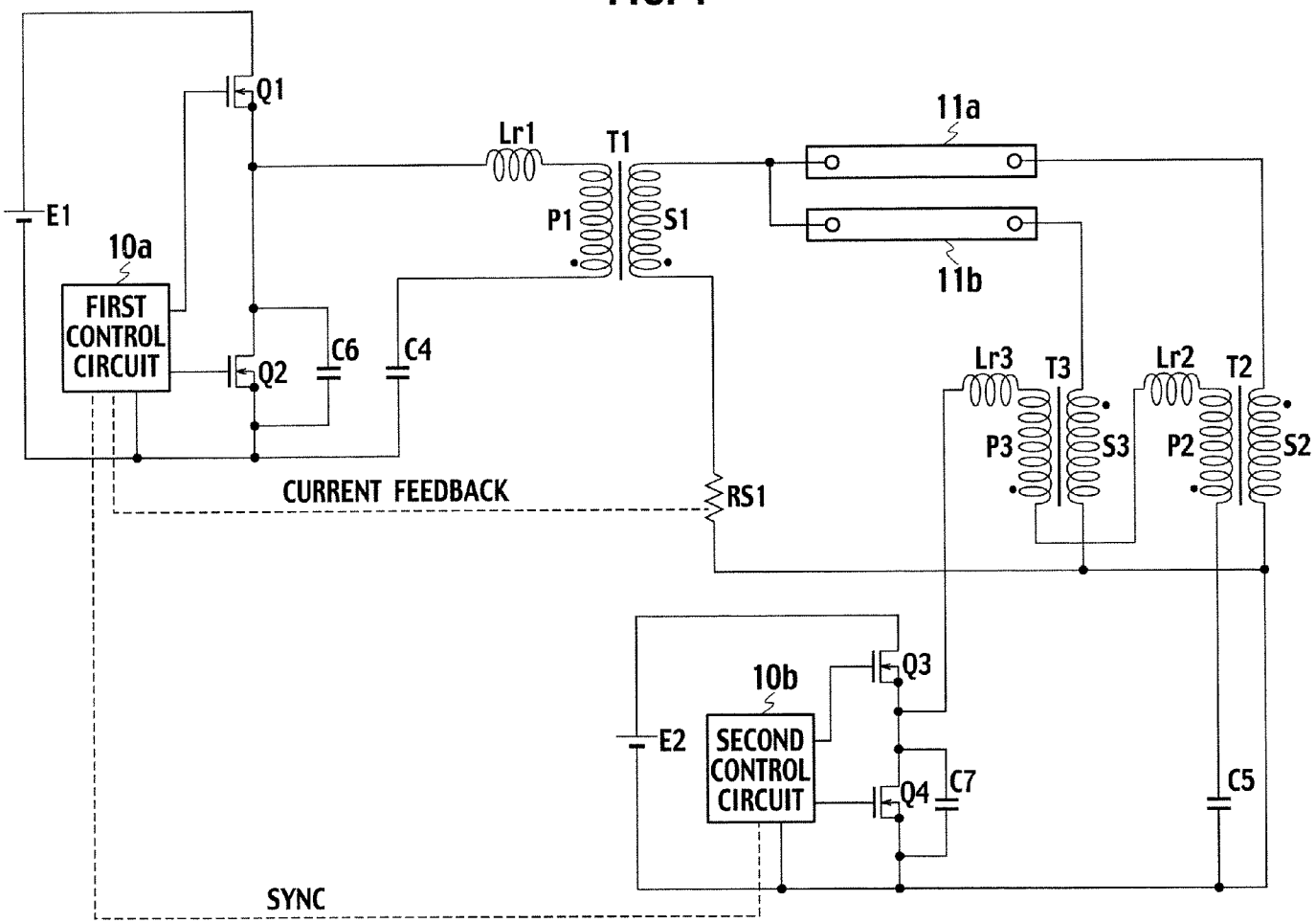
FIG. 4 is a view showing a configuration of a discharge-lamp lighting apparatus according to a second embodiment of the present invention.

FIG. 4 is a view showing a discharge-lamp lighting apparatus according to the second embodiment of the present invention.

The second transformer T2 employed by the first embodiment is divided into a second transformer T2 and a third transformer T3. The second transformer T2 has a primary winding P2 and a secondary winding S2, and the third transformer T3 has a primary winding P3 and a secondary winding S3. The second and third transformers T2 and T3 have leakage inductances Lr2 and Lr3, respectively, for managing resonance operation.

The primary winding P2 of the second transformer T2 and the primary winding P3 of the third transformer T3 are connected in series with each other. The primary winding P2 of the second transformer T2, the primary winding P3 of the third transformer T3, and a current resonance capacitor C5 form a series circuit that receives an AC voltage generated by turning on/off a third switching element Q3 and a fourth switching element Q4.

A secondary winding S1 of a first transformer T1 is connected in parallel to a series circuit that includes a CCFL 11*a* and the secondary winding S2 of the second transformer T2 and a series circuit that includes a CCFL 11*b* and the secondary winding S3 of the third transformer T3. The secondary windings S2 and S3 of the second and third transformers T2 and T3 are connected to the secondary winding S1 of the first transformer T1 with polarities being set so that voltages generated by the secondary windings S2 and S3 of the second and third transformers T2 and T3 become additive to a voltage generated by the secondary winding S1 of the first transformer T1.

Operation of the discharge-lamp lighting apparatus according to the second embodiment having the above-mentioned configuration will be explained. An AC voltage applied to a primary winding P1 of the first transformer T1 makes the secondary winding S1 thereof generate a voltage. AC voltages applied to the primary windings P2 and P3 of the second and third transformers T2 and T3 make the secondary windings S2 and S3 thereof generate voltages. As results, the CCFL 11*a* receives the sum of the voltage of the secondary winding S1 of the first transformer T1 and the voltage of the secondary winding S2 of the second transformer T2, and the CCFL 11*b* receives the sum of the voltage of the secondary winding S1 of the first transformer T1 and the voltage of the secondary winding S3 of the third transformer T3.

As a result, the CCFLs 11*a* and 11*b* turn on. Since the secondary windings S2 and S3 of the second and third transformers T2 and T3 are independent of each other, ON operation of one of the CCFLs 11*a* and 11*b* little affects ON operation of the other. Namely, the CCFLs 11*a* and 11*b* can stably be turned on.

The secondary windings S2 and S3 of the second and third transformers T2 and T3 each have a predetermined inductance to balance currents passing through the CCFLs 11*a* and 11*b*.

The voltage applied to the CCFL 11*a* is shared between the first and second transformers T1 and T2, and the voltage applied to the CCFL 11*b* is shared between the first and third transformers T1 and T3, and therefore, an output voltage provided by any one of the first, second, and third transformers T1, T2, and T3 can be lower than that of the related art. This results in eliminating the need of large-scale safety measures to secure reliability, prevent leakage, and ensure creepage distances and spatial distances, thereby minimizing the cost of the apparatus.

In FIG. 4, a resistor RS1 arranged between the secondary winding S1 of the first transformer T1 and the secondary windings S2 and S3 of the second and third transformers T2 and T3 is an optional current detector as an impedance element to detect a current passing through the CCFLs 11*a* and 11*b*. If the resistor RS1 is arranged, a voltage detected by the resistor RS1 is fed back as a signal representative of a current value to a first control circuit 10*a* on the primary side of the apparatus.

According to the signal fed back from the resistor RS1, the first control circuit 10*a* controls on/off periods of first and second switching elements Q1 and Q2, thereby controlling an AC voltage applied to the primary winding P1 of the first transformer T1.

It is possible to configure the discharge-lamp lighting apparatus so that the signal representative of a current value detected by the resistor RS1 is fed back to a second control circuit 10*b* on the secondary side of the apparatus. In this case, the second control circuit 10*b* controls on/off periods of the third and fourth switching elements Q3 and Q4 according to the signal fed back from the resistor RS1, to thereby control AC voltages applied to the primary windings P2 and P3 of the second and third transformers T2 and T3.

It is also possible to configure the discharge-lamp lighting apparatus so that the signal representative of a current value detected by the resistor RS1 is fed back to the first control circuit 10*a* as well as to the second control circuit 10*b*, to control both the AC voltage applied to the primary winding P1 of the first transistor T1 and the AC voltages applied to the primary windings P2 and P3 of the second and third transformers T2 and T3.

According to the discharge-lamp lighting apparatus of the second embodiment, the primary windings P2 and P3 of the second and third transformers T2 and T3 are connected in series with each other. Instead, according to a modification shown in FIG. 5, the primary windings P2 and P3 of the second and third transformers T2 and T3 may be connected in parallel to each other. The discharge-lamp lighting apparatus of the modification can provide the same operation and effect as the discharge-lamp lighting apparatus of the second embodiment.

Third Embodiment

Figure 5:
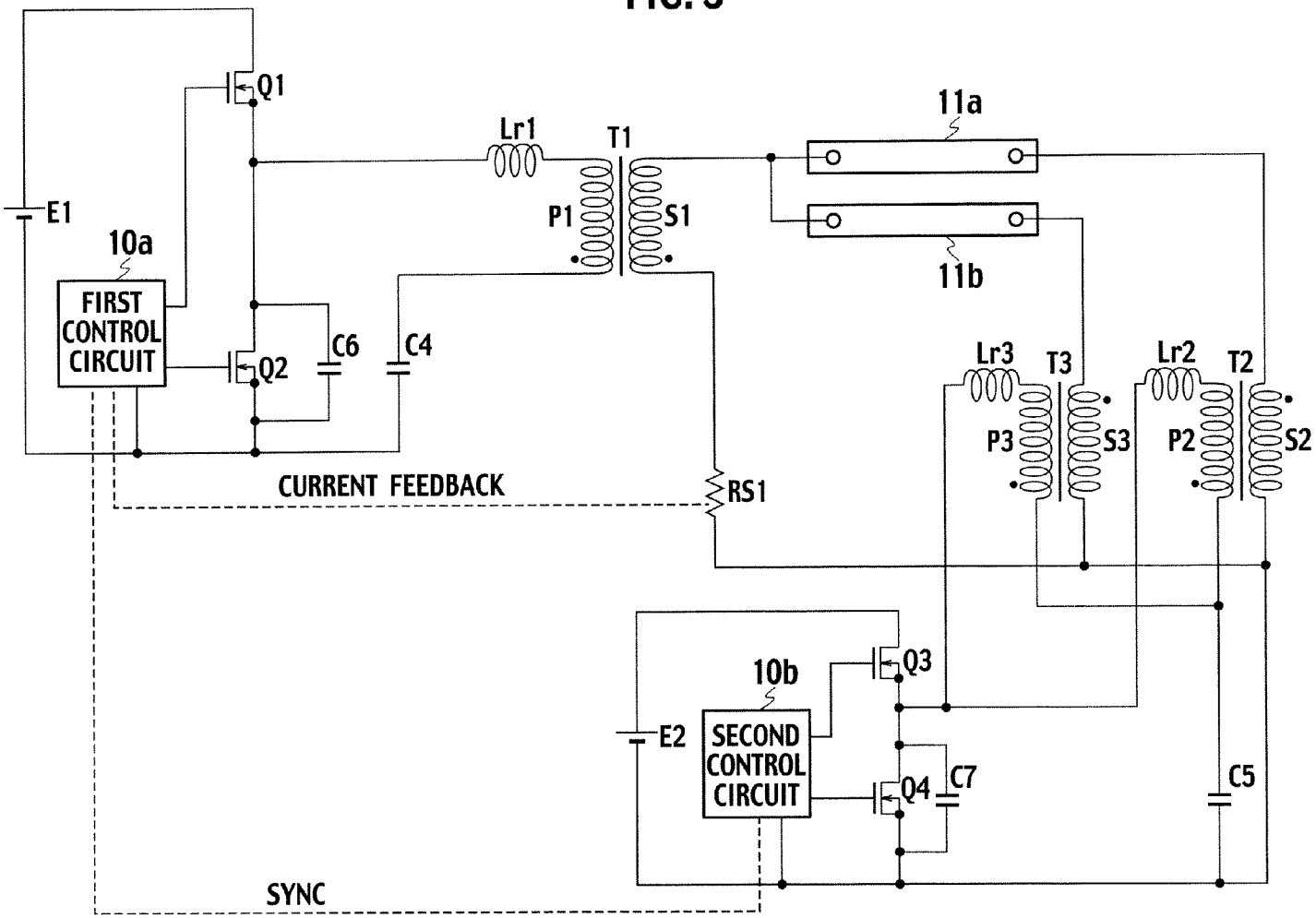
FIG. 5 is a view showing a configuration of a discharge-lamp lighting apparatus according to a modification of the second embodiment of the present invention.
Figure 6:
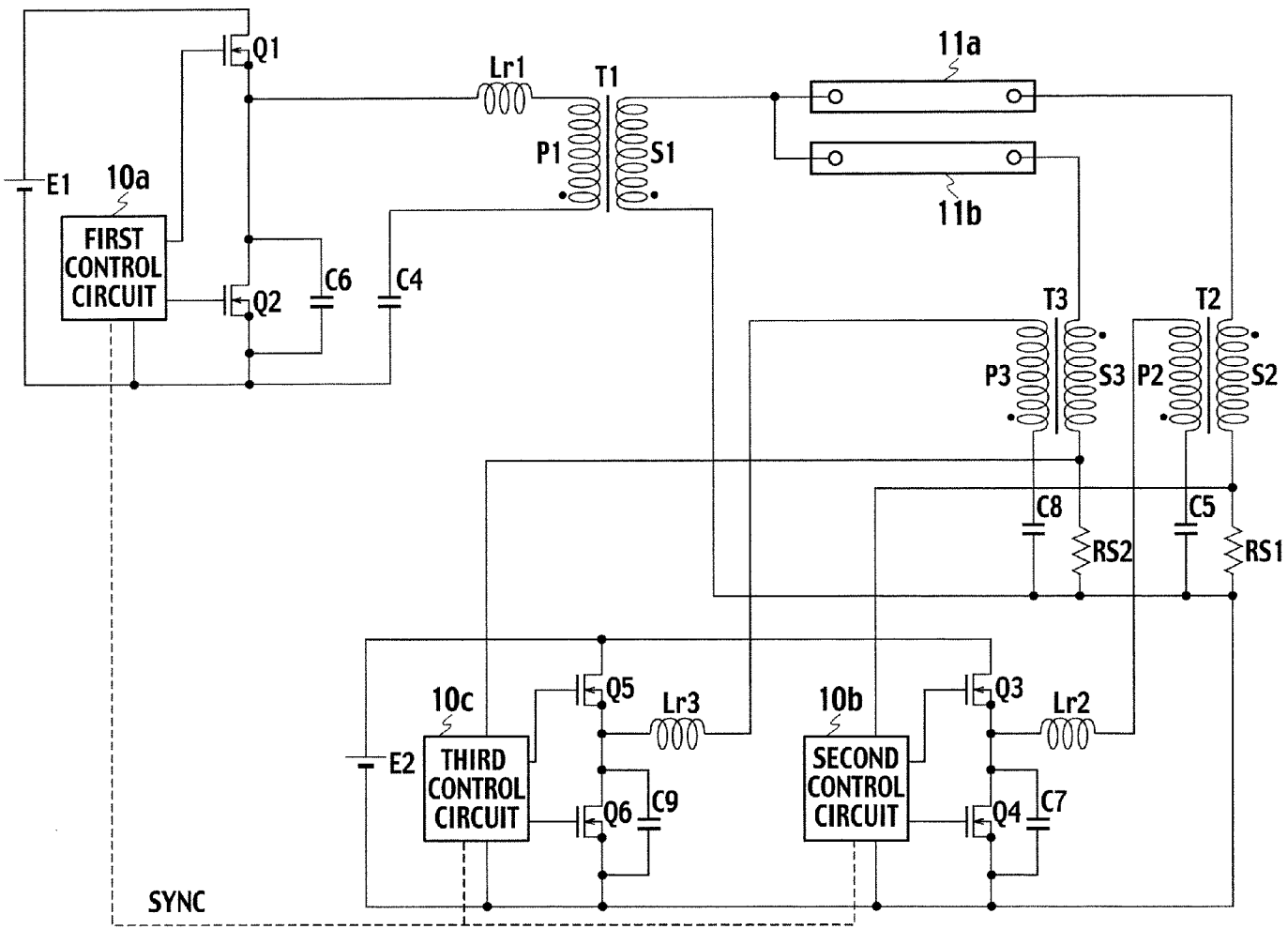
FIG. 6 is a view showing a configuration of a discharge-lamp lighting apparatus according to a third embodiment of the present invention.

FIG. 6 is a view showing a discharge-lamp lighting apparatus according to the third embodiment of the present invention. The third embodiment disconnects the series connection of the primary windings P2 and P3 of the second and third transformers T2 and T3 of the modification of the second embodiment as shown in FIG. 5 and additionally employs a third control circuit 10*c*, a fifth switching element Q5, a sixth switching element Q6, a current resonance capacitor C8, and a quasi-voltage-resonance capacitor C9.

The fifth and sixth switching elements Q5 and Q6 are connected in series with a second DC power source E2 and are turned on/off in response to control signals from the third control circuit 10*c*. The third control circuit 10*c* conducts PWM control, phase control, frequency control, or the like to control the on/off operation of the fifth and sixth switching elements Q5 and Q6. The sixth switching element Q6 is connected in parallel to the quasi-voltage-resonance capacitor C9. The element Q6 is also connected in parallel to a series circuit that includes a primary winding P3 of the third transformer T3 and the current resonance capacitor C8. A first control circuit 10*a*, a second control circuit 10*b*, and the third control circuit 10*c* are controlled so that control signals provided by them are frequency-synchronized.

Operation of the discharge-lamp lighting apparatus according to the third embodiment with the above-mentioned configuration resembles that of the modification of the second embodiment. Namely, a voltage applied to a CCFL 11*a* is shared between the first and second transformers T1 and T2, and a voltage applied to a CCFL 11*b* is shared between the first and third transformers T1 and T3. Accordingly, an output voltage provided by any one of the first, second, and third transformers T1, T2, and T3 can be lower than that of the related art. This results in eliminating the need of large-scale safety measures to secure reliability, prevent leakage, and ensure creepage distances and spatial distances, thereby minimizing the cost of the apparatus.

A resistor RS1 arranged between the secondary winding S1 of the first transformer T1 and the secondary winding S2 of the second transformer T2 and a resistor RS2 arranged between the secondary winding S1 of the first transformer T1 and the secondary winding S3 of the third transformer T3 are optional current detectors as impedance elements to detect currents passing through the CCFLs 11*a* and 11*b*, respectively. The resistors RS1 and RS2 correspond to first and second current detection elements of the present invention.

If the resistor RS1 is arranged, a voltage detected by the resistor RS1 is fed back as a signal representative of a current value to the second control circuit 10*b*. According to the signal fed back from the resistor RS1, the second control circuit 10*b* controls on/off periods of third and fourth switching elements Q3 and Q4, thereby controlling an AC voltage applied to the primary winding P2 of the second transformer T2.

In the similar manner, if the resistor RS2 is arranged, a voltage applied to the CCFL 11*b* and detected by the resistor RS2 is fed back as a signal representative of a current value to the third control circuit 10*c*. According to the signal fed back from the resistor RS2, the third control circuit 10*c* controls on/off periods of the fifth and sixth switching elements Q5 and Q6, thereby controlling an AC voltage applied to the primary winding P3 of the third transformer T3.

If the resistors RS1 and RS2 are arranged, the first control circuit 10*a* may simply control the first and second switching elements Q1 and Q2 so that they may regularly turn on/off, to eliminate the feedback control from the secondary side. This configuration has an advantage that a constant voltage power source on the secondary side can be used as the second DC power source E2. It also has an advantage that voltages detected by the resistors RS1 and RS2 can be fed back only on the secondary side in a non-insulating manner.

In addition, this configuration can separately carry out the feedback control for the CCFLs 11*a* and 11*b*, to accurately balance currents. Namely, main energy can be supplied from the primary side through the first transformer T1, and auxiliary energy for balancing currents can be supplied from the secondary side. In this case, low power switching elements can be employed as the third to sixth switching elements Q3 to Q6 on the secondary side.

The discharge-lamp lighting apparatuses according to the first to third embodiments each have the separated first and second DC power sources E1 and E2. Instead, it is possible to commonly use a single power source as the power sources E1 and E2, to reduce the number of power sources and simplify the structure of the discharge-lamp lighting apparatus.

Although the discharge-lamp lighting apparatuses according to the first to third embodiments each control two CCFLs, the discharge-lamp lighting apparatus according to the present invention is applicable to control an optional number of CCFLs.

The present invention can realize a discharge-lamp lighting apparatus that is manufacturable at low cost, is highly reliable, and is capable of simultaneously driving a plurality of CCFLs.

EFFECT OF THE INVENTION

The discharge-lamp lighting apparatus according to the present invention generates voltages applied to first and second discharge lamps from first and second (and third, too) transformers in a shared manner to reduce a voltage to be generated by each transformer. This results in eliminating large-scale safety measures to be taken for the apparatus, greatly reducing the cost of the apparatus, and improving the reliability of the apparatus.

Supplying voltages to the first and second discharge lamps with the use of the second and/or third transformers provides an advantage that an inductance of each transformer can be used as an impedance to absorb the negative resistance characteristics of the first and second discharge lamps. This results in stably balancing currents passing through the discharge lamps that are simultaneously driven.

This application claims benefit of priority under 35USC §119 to Japanese Patent Application No. 2006-145731, filed on May 25, 2006, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A discharge-lamp lighting apparatus having a first discharge lamp and a second discharge lamp, comprising:

a first control circuit configured to control on/off operation of a first switching element pair connected in series with a first DC power source;

a first transformer having a primary winding configured to receive an AC voltage generated by turning on/off the first switching element pair and a secondary winding configured to transform the AC voltage received by the primary winding into an output voltage;

a second control circuit configured to control on/off operation of a second switching element pair connected in series with a second DC power source; and a second transformer having a primary winding configured to receive an AC voltage generated by turning on/off the second switching element pair and first and second secondary windings configured to transform the AC voltage received by the primary winding of the second transformer into output voltages, each of the first and second secondary windings being connected to the secondary winding of the first transformer with polarities being set so that the voltage of each of the first and second secondary windings becomes additive to the voltage of the secondary winding of the first transformer, wherein:

the first discharge lamp is connected in parallel to a series circuit that includes the secondary winding of the first transformer and the first secondary winding of the second transformer; and the second discharge lamp is connected in parallel to a series circuit that includes the secondary winding of the first transformer and the second secondary winding of the second transformer.

2. The discharge-lamp lighting apparatus of claim 1, wherein a control signal provided by the first control circuit to turn on/off the first switching element pair and a control signal provided by the second control circuit to turn on/off the second switching element pair are frequency-synchronized with each other.

3. The discharge-lamp lighting apparatus of claim 1, wherein the first and second secondary windings of the second transformer are loosely coupled to each other.

4. The discharge-lamp lighting apparatus of claim 1, wherein a single DC power source is commonly used as the first and second DC power sources.

5. A discharge-lamp lighting apparatus having a first discharge lamp and a second discharge lamp, comprising:

a first control circuit configured to control on/off operation of a first switching element pair connected in series with a first DC power source;

a first transformer having a primary winding configured to receive an AC voltage generated by turning on/off the first switching element pair and a secondary winding configured to transform the AC voltage received by the primary winding into an output voltage;

a second control circuit configured to control on/off operation of a second switching element pair connected in series with a second DC power source;

a second transformer having a primary winding configured to receive an AC voltage generated by turning on/off the second switching element pair and a secondary winding configured to transform the AC voltage received by the primary winding of the second transformer into an output voltage, the secondary winding of the second transformer being connected to the secondary winding of the first transformer with polarities being set so that the voltage of the secondary winding of the second transformer becomes additive to the voltage of the secondary winding of the first transformer; and a third transformer having a primary winding configured to receive an AC voltage generated by turning on/off the second switching element pair and a secondary winding configured to transform the AC voltage received by the primary winding of the third transformer into an output voltage, the secondary winding of the third transformer being connected to the secondary winding of the first transformer with polarities being set so that the voltage of the secondary winding of the third transformer becomes additive to the voltage of the secondary winding of the first transformer, wherein:

the first discharge lamp is connected in parallel to a series circuit that includes the secondary winding of the first transformer and the secondary winding of the second transformer;

the second discharge lamp is connected in parallel to a series circuit that includes the secondary winding of the first transformer and the secondary winding of the third transformer; and the primary winding of the second transformer and the primary winding of the third transformer are connected to each other in one of series and parallel.

6. The discharge-lamp lighting apparatus of claim 5, wherein a control signal provided by the first control circuit to turn on/off the first switching element pair and a control signal provided by the second control circuit to turn on/off the second switching element pair are frequency-synchronized with each other.

7. The discharge-lamp lighting apparatus of claim 5, further comprising:

a current detector configured to detect a current passing through the first discharge lamp and second discharge lamp, wherein:

at least one of the on/off control of the first switching element pair by the first control circuit and the on/off control of the second switching element pair by the second control circuit is carried out according to a current value detected by the current detector.

8. The discharge-lamp lighting apparatus of claim 5, wherein a single DC power source is commonly used as the first and second DC power sources.

9. A discharge-lamp lighting apparatus having a first discharge lamp and a second discharge lamp, comprising:

a first control circuit configured to control on/off operation of a first switching element pair connected in series with a first DC power source;

a first transformer having a primary winding configured to receive an AC voltage generated by turning on/off the first switching element pair and a secondary winding configured to transform the AC voltage received by the primary winding into an output voltage;

a second control circuit configured to control on/off operation of a second switching element pair connected in series with a second DC power source;

a second transformer having a primary winding configured to receive an AC voltage generated by turning on/off the second switching element pair and a secondary winding configured to transform the AC voltage received by the primary winding of the second transformer into an output voltage, the secondary winding of the second transformer being connected to the secondary winding of the first transformer with polarities being set so that the voltage of the secondary winding of the second transformer becomes additive to the voltage of the secondary winding of the first transformer;

a third control circuit configured to control on/off operation of a third switching element pair connected in series with the second DC power source; and a third transformer having a primary winding configured to receive an AC voltage generated by turning on/off the third switching element pair and a secondary winding configured to transform the AC voltage received by the primary winding of the third transformer into an output voltage, the secondary winding of the third transformer being connected to the secondary winding of the first transformer with polarities being set so that the voltage of the secondary winding of the third transformer becomes additive to the voltage of the secondary winding of the first transformer, wherein:

the first discharge lamp is connected in parallel to a series circuit that includes the secondary winding of the first transformer and the secondary winding of the second transformer; and the second discharge lamp is connected in parallel to a series circuit that includes the secondary winding of the first transformer and the secondary winding of the third transformer.

10. The discharge-lamp lighting apparatus of claim 9, further comprising:

a first current detector configured to detect a current passing through the first discharge lamp; and a second current detector configured to detect a current passing through the second discharge lamp, wherein:

the second control circuit controls on/off operation of the second switching element pair according to a current value detected by the first current detector; and the third control circuit controls on/off operation of the third switching element pair according to a current value detected by the second current detector.

11. The discharge-lamp lighting apparatus of claim 10, wherein a control signal provided by the first control circuit to turn on/off the first switching element pair, a control signal provided by the second control circuit to turn on/off the second switching element pair, and a control signal provided by the third control circuit to turn on/off the third switching element pair are frequency-synchronized with one another.

12. The discharge-lamp lighting apparatus of claim 9, wherein a control signal provided by the first control circuit to turn on/off the first switching element pair, a control signal provided by the second control circuit to turn on/off the second switching element pair, and a control signal provided by the third control circuit to turn on/off the third switching element pair are frequency-synchronized with one another.

13. The discharge-lamp lighting apparatus of claim 9, wherein a single DC power source is commonly used as the first and second DC power sources.

* * * * *